United States Patent [19]

Yamada

[11] 4,335,454

[45] Jun. 15, 1982

[54] GEAR TRAIN MECHANISM FOR A TIMEPIECE

[75] Inventor: Haruyoshi Yamada, Suwa, Japan

[73] Assignee: Kabushiki Kaisha Suwa Seikosha, Tokyo, Japan

[21] Appl. No.: 93,097

[22] Filed: Nov. 9, 1979

[30] Foreign Application Priority Data

Nov. 17, 1978 [JP] Japan ..... 53-141891

[51] Int. Cl.[3] ..... G04B 19/02

[52] U.S. Cl. ..... 368/220

[58] Field of Search ..... 368/62–88, 368/217, 322, 220, 223, 228

[56] References Cited

U.S. PATENT DOCUMENTS 3,277,644 10/1966 Nomura et al. ..... 368/80

4,104,859 8/1978 Ogihara et al. ..... 368/76

*Primary Examiner*—Vit W. Miska

*Attorney, Agent, or Firm*—Blum, Kaplan, Friedman, Silberman and Beran

[57] ABSTRACT

The fifth or intermediate wheel and pinion assembly of a gear train cooperates directly with the motor rotor pinion and the fourth wheel to provide a full stepdown in angular rotation between the motor rotor and a second hand. The upper tenon of the fourth wheel and pinion is supported on a third wheel bridge, and the upper tenon of the fifth wheel and pinion is supported on a fifth wheel bridge with the fifth wheel overlapping the tenon of the fourth wheel and pinion. This overlapping and elimination of wheels provides a compact, reliable and durable gear train for a timepiece of reduced dimensions.

9 Claims, 5 Drawing Figures

GEAR TRAIN MECHANISM FOR A TIMEPIECE

BACKGROUND OF THE INVENTION

This invention relates generally to a gear train of the type used in an analog timepiece and more particularly to a gear train mechanism wherein wheels in the train between the motor rotor and the second hand are substantially overlapped and the number of wheels in said train is reduced over the conventionally used gear trains.

In recent years, with progress in the electronic arts, the elements of a timepiece have been made small in size and thin, and as a result, it has been possible to produce thin electric timepieces. However, the face of the electric timepiece remained large, or when the timepieces were small in size, they were not provided with a second hand. On the other hand, during the same years, market demand from users has been continuously directed to the design of a timepiece which is small in face size, thin and yet provides for performance of multifunctions such as provision of a second hand.

In order to provide a small-sized timepiece, the parts of the timepiece, for example, the battery, coil, gear train, etc., must be made as small as possible and must also be arranged as close as possible to the center of the timepiece. Generally speaking, when making a small and thin timepiece, the outer diameter of a timepiece having three hands, namely, a second, minute and hour hand, is defined by the outer diameter of the battery and the radius of the wheel for driving the second hand, that is, the fourth wheel. As the dimensions of a battery greatly influence its capacity for power delivery, and in view of the relationship between current consumption and battery life, there is a practical limit to any reductions in size which may be made in battery design.

At the present time, taking as an example a three-handed timepiece with a battery life of nearly two years, a battery with an outer diameter of 7.9 millimeters and a thickness of 2.7 millimeters is the smallest which can be used. Applying this battery in a timepiece having an outer diameter of about 18 millimeters, the diameter of the wheel for driving the second hand must be about 2 millimeters. This is a small and often inconvenient dimension for mass-production methods.

What is needed is a gear train mechanism for a timepiece which is compact and provides a highly reliable timepiece of small dimensions and having reduced mechanical complexity.

SUMMARY OF THE INVENTION

Generally speaking, in accordance with the invention, a gear train mechanism for a timepiece especially suited for producing a small-sized timepiece is provided. In the gear train mechanism of this invention, a fifth or intermediate wheel and pinion assembly cooperates directly with the motor rotor pinion and a fourth wheel to provide a full stepdown in angular rotation between the motor rotor and a second hand which is attached to the shaft of the fourth wheel. The upper tenon of the fourth wheel and pinion assembly is supported on a third wheel bridge, and the upper tenon of the fifth wheel and pinion assembly is supported on a fifth wheel bridge, with the fifth wheel overlapping the tenon of the fourth wheel and pinion. This overlapping and elimination of wheels provides a reliable gear train for a timepiece of reduced dimensions.

Accordingly, it is an object of this invention to provide an improved gear train mechanism for a timepiece wherein the number of wheels between the motor rotor and the second hand is reduced.

Another object of this invention is to provide an improved gear train mechanism for a timepiece wherein a wheel of a wheel and pinion assembly in a gear train overlaps the tenon of another engaged wheel and pinion assembly in the same train.

A further object of this invention is to provide an improved gear train mechanism for a timepiece which avoids the use of very small wheels.

Still another object of this invention is to provide an improved gear train mechanism for a timepiece which is reliable and rugged and easy to assemble in mass production.

Yet another object of this invention is to provide an improved gear train mechanism for a three-handed timepiece of small size.

A further object of this invention is to provide an improved gear train mechanism wherein only a single wheel and pinion assembly operates intermediate the motor rotor and the wheel attached to the second hand.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENT

Figure 1:
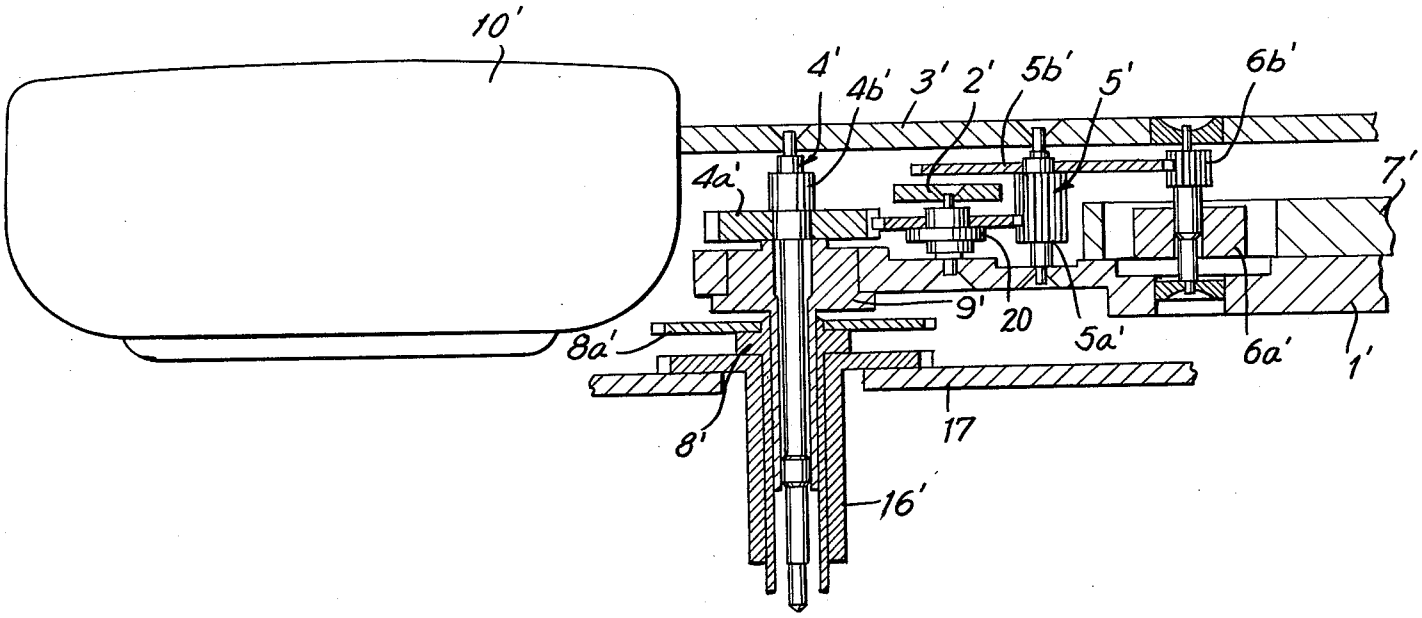
FIG. 1 PRIOR ART
FIG. 1 is a partial sectional view in elevation to an enlarged scale of a conventional gear train mechanism for a timepiece of the prior art.

The gear train mechanism of this invention is an improvement over the mechanism disclosed in the Japanese patent application laid open under No. 88766/78 and provides a small-sized timepiece of good quality. In that Japanese application, a construction for a gear train as shown in FIG. 1 has been disclosed as being applied to a comparatively small-sized timepiece wherein the diameter of the wheel directly connected to the second hand is small. However, this structure has many disadvantages, for example, unsuitable setting means for setting the second hand while the second hand is being driven, loss of torque due to a friction spring required on the sweep second pinion in order to solve the setting problem, a fall in transmitting efficiency of the output torque of the motor due to an increase in the number of wheels, etc. These disadvantages are shown and described in the above-mentioned Japanese Patent Application No. 88766/78, and the mechanism first disclosed in that application has been devised to eliminate the cited disadvantages. However, many deficiencies in the mechanism remain.

Figure 2:
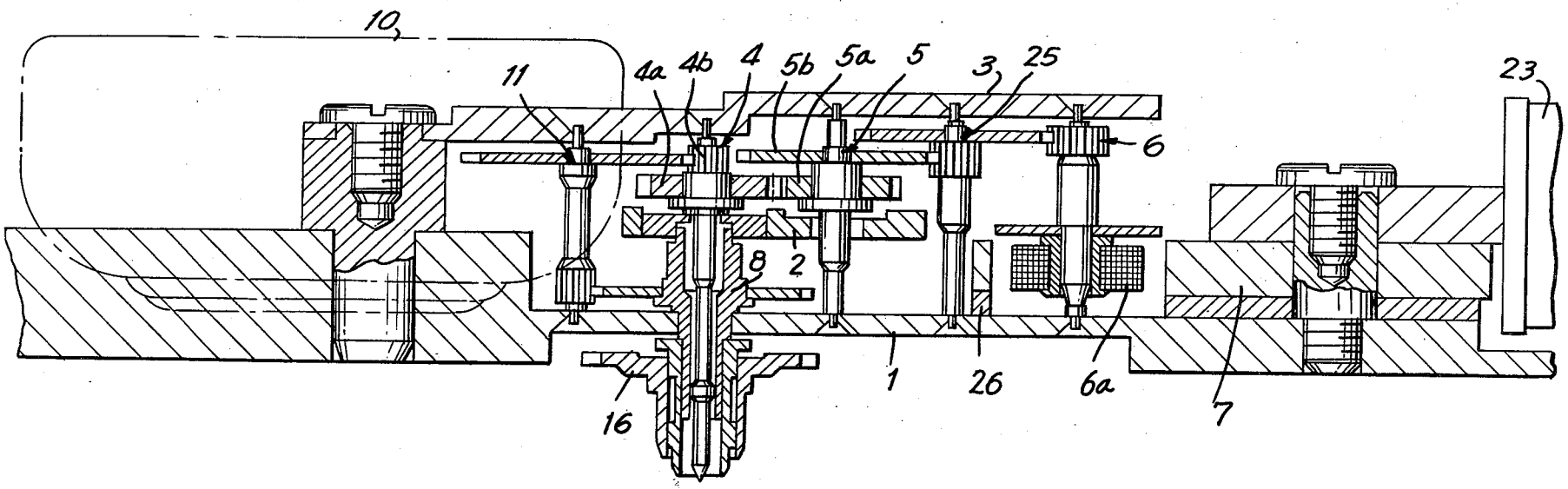
FIG. 2 PRIOR ART
FIG. 2 is a view similar to FIG. 1 of another conventional gear train mechanism of the prior art.
Figure 3:
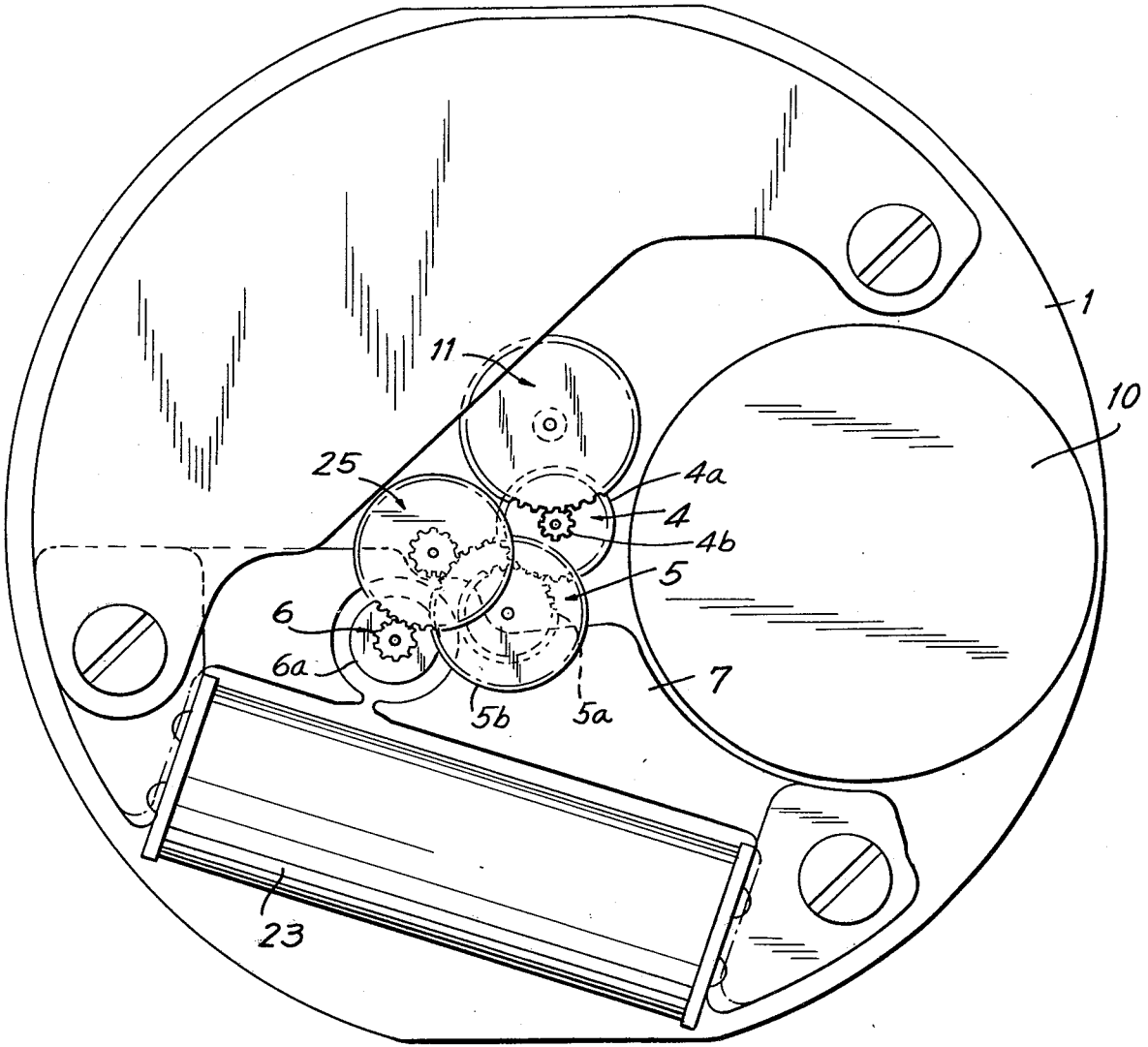
FIG. 3 PRIOR ART
FIG. 3 is a plan view of the mechanism of FIG. 2.

The gear train mechanism disclosed and claimed in the Japanese patent application laid open under No. 88766/78 is illustrated in elevational section in FIG. 2 and in plan view in FIG. 3. The third wheel bridge 2 and the fifth wheel bridge 3 are omitted from FIG. 3 for the sake of clarity in illustration. It should also be understood that in FIG. 2, all tenons are illustrated as though they were located in a common plane; however, FIG. 3 shows an accurate physical relationship between the wheels as discussed more fully hereinafter.

In FIG. 2, the electric motor includes a stator 7, a magnetic coil 23 and a rotor 6 having opposed magnetic-pole pieces 6*a*. The rotor 6 repeats an action of repulsion and attraction of the magnetic-pole pieces 6*a* with the magnetic field generated by the coil 23 and the stator 7. A circuit element 26 provides a timekeeping signal which is applied to the coil 23, and electrical energy is supplied from a battery 10. Thus, the rotor 6 rotates 180 degrees every time an output signal is applied to the magnetic coil 23, all in the known manner. Accordingly, when driving the second hand by one step every second around the face of the dial (not shown), the deceleration in angular velocity from the rotor 6 to the fourth wheel and pinion assembly 4 is 1/30. Energy is transmitted from the rotor 6 to the wheel and pinion assembly 25, to wheel 5*b*, and from wheel 5*a* to wheel 4*a*. The fourth wheel and pinion assembly 4 is used for direct attachment with the second hand on the face of the timepiece. The hands for indicating seconds, minutes and hours are not shown in the Figures.

The number of teeth on the pinion 5*a* of the fifth wheel and pinion assembly 5 is 48, and the fourth wheel 4*a* has 60 teeth. As a result, the angular deceleration from the fifth wheel pinion 5*a* to the fourth wheel 4*a* is 1/1.25. In this embodiment, the difference in the number of teeth between the two elements is made small so as to prevent the second hand from getting out of its proper position. Details of this second hand problem are disclosed in the aforementioned application No. 88766/78. The remaining angular deceleration of 1/24 needed to provide an overall deceleration of 1/30 is accomplished by using the additional sixth wheel and pinion assembly 25. Consequently, for the 1/30 angular deceleration from the rotor 6 to the fourth wheel and pinion assembly 4, there must be four wheels.

A third wheel and pinion assembly 11 engaging a pinion 4*b* is used to drive the minute hand through the center wheel and pinion assembly 8.

Note in FIG. 2 that the tenons for the wheel and pinion assemblies 4, 5, 11, 25 and rotor 6 are rotatably supported by one supporting plate, i.e., the fifth wheel bridge 3. Lower tenons are mounted to a plate 1 and central support is provided by the third wheel bridge 2. This structure with a common support for most upper tenons may convey an impression that the timepiece is thin. However, in fact, the space made available by removing one supporting plate to contain the tenons is counterbalanced by the addition of one wheel. The expected result of thinness is not actually realized. On the contrary, an increase of the vertical dimension for the gear train and a decrease in transmission efficiency of the motor output to the fourth wheel and pinion assembly 4 are disadvantageous factors in opposition to successful miniaturization of a timepiece. A further disadvantage resides in the increase in the number of operational steps required for assembly of a timepiece caused by the increase in the number of parts. The increased complexity in production is caused by adding the one wheel and pinion.

The prior art gear train of FIG. 1 is not given a detailed description herein, as the construction will be readily apparent upon examination by persons skilled in the art, and its operation is similar to the operation of the embodiment of FIGS. 2 and 3. Corresponding components of both prior art embodiments have reference numerals which are distinguished only by the prime marking (') used in FIG. 1.

Figure 4:
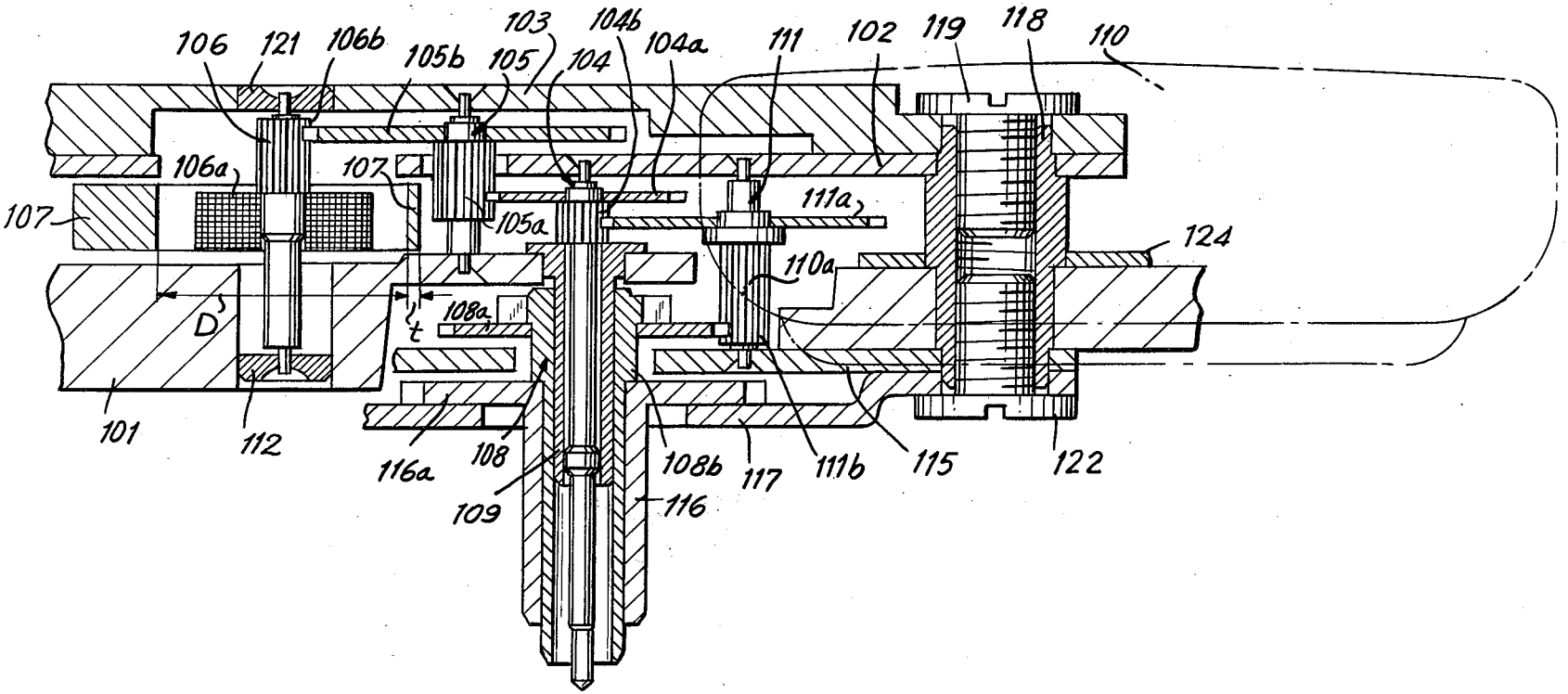
FIG. 4 is a partial sectional view in elevation and to an enlarged scale of a gear train mechanism according to this invention.
Figure 5:
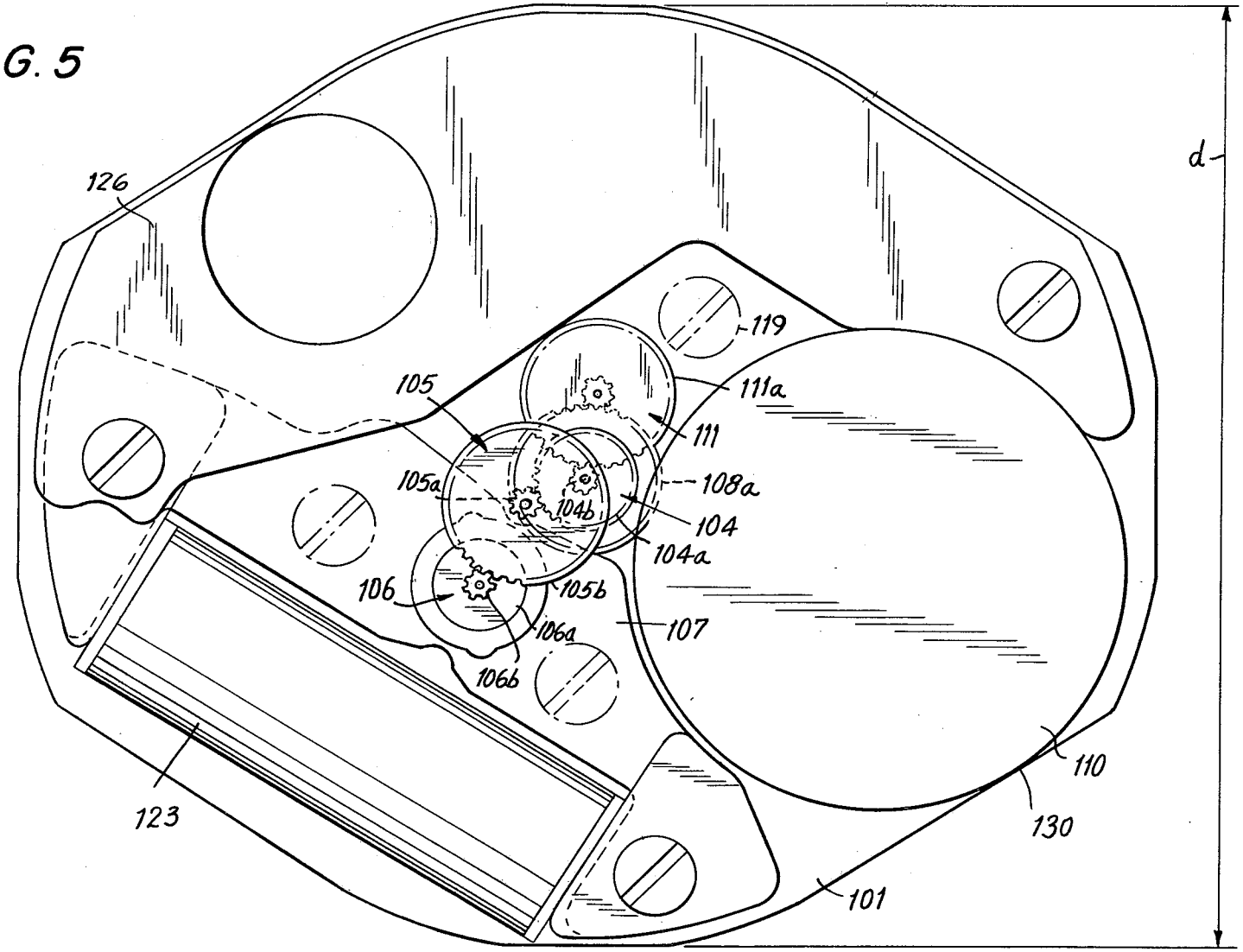
FIG. 5 is a plan view of the mechanism of FIG. 4.

The gear train mechanism of this invention eliminates the deficiencies and disadvantages of the prior art embodiments described above. FIG. 4 is an enlarged elevational, sectional view of a gear train mechanism according to this invention. FIG. 5 is a plan view of the mechanism of FIG. 4 wherein the third wheel bridge 102 and the fifth wheel bridge 103 have been omitted for the sake of clarity in illustration.

A third wheel bridge 102 and a fifth wheel bridge 103 are located by a bridge foot pin 118 and other similar pins which are not shown in the Figures. The foot pins 118 are secured by screws, for example, a screw 119. The motor is a stepping motor having two poles including a rotor 106, a stator 107 and a magnetic coil 123. Components in FIGS. 4 and 5 have the reference numerals plus 100 of corresponding components in FIGS. 2 and 3. The motor rotor 106 is rotatably supported by a bearing jewel 121 fixed in the fifth wheel bridge 103 and by the bearing jewel 112 fixed in the plate 101. A rotor magnet 106*a*, magnetized to have two opposing poles, is fixed to the motor rotor 106. The rotor magnet 106*a* rotates 180 degrees for one output pulse from the timekeeping circuit 126 in response to the action of repulsion and attraction of the opposed poles in the magnetic field generated by the coil 23 and in the stator 7, in the known manner.

Accordingly, in a timepiece wherein the second hand steps every second, a deceleration in angular velocity from the rotor 106 to the fourth wheel and pinion assembly 104, which is used for carrying the second hand in rotation, is 1/30. That is, a 180-degree rotation of the rotor 106 produces a 6-degree rotation of the second hand.

The upper and lower tenons of the intermediate or fifth wheel and pinion assembly 105 are rotatably supported by the fifth wheel bridge 103 and the plate 101, respectively. The intermediate fifth wheel 105*b* engages directly with the rotor pinion 106*b*. The fourth wheel and pinion assembly 104 is rotatably supported on the internal surfaces of a shaft 109 which supports a center wheel and pinion assembly 108 on its external surfaces. A minute hand (not shown) attaches to the center wheel and pinion assembly 108.

The shaft 109 is supported on the plate 101 and restrained by engagement of the upper tenon of the fourth wheel and pinion assembly 104 in the third-wheel bridge 102. The fourth wheel 104*a* engages with the intermediate or fifth wheel pinion 105*a*. Accordingly, the output of the motor is transmitted to the fourth wheel and pinion assembly 104 through the rotor 106 and the fifth wheel 105*b* and pinion 105*a*.

A battery 110 has one circumferential edge (FIG. 5) positioned close to the outer edge 130 of the plate 101, and the other opposed circumferential edge of the battery 110 is positioned near the fourth wheel 104*a*. The third wheel and pinion assembly 111 is rotatably supported at the top by the third wheel bridge 102 and at the lower end by the lower end piece 115, which is positioned on the opposite side of the plate 101 with respect to the third wheel bridge 102. The third wheel 111*a* engages with the fourth wheel pinion 104*b*, and wheel 111*a* also extends close to the battery 110.

In this embodiment (FIGS. 4 and 5), the fifth wheel bridge 103 rotatably supports the upper tenons of the rotor assembly 106 and the fifth wheel and pinion assembly 105. The third wheel bridge 102 rotatably supports the upper tenons of the wheel and pinion assembly 104 and of the third wheel and pinion assembly 111. Thus, support of the tenons during assembly of the gear train mechanism is improved by apportioning the four wheels from the rotor 106 to the third wheel and pinion assembly 111 equally, two by two, on the two supporting plates 102, 103. The third wheel 111*a* horizontally overlaps the setting lever spring 124 which composes a part of the setting mechanism. One end of the setting lever spring 124 is aligned by the bridge foot pin 118 which is fixed to the plate 101 by a screw 122.

The center wheel and pinion assembly 108, which carries a minute hand, is positioned opposite to the mountings for the fourth wheel and pinion assembly 104 with respect to the plate 101 and is rotatably aligned to the external surface of the shaft 109. As stated above, the internal surface of the shaft 109 aligns the fourth wheel and pinion assembly 104, and the center wheel 108*a* engages the third wheel pinion 111*b*. The center wheel 108*a* is resiliently attached to the center wheel pinion 108*b* so that the wheel 108*a* may rotate as a unit with the center wheel pinion 108*b* during usual movement of the hands. However, the resilient mounting of center wheel 108*a* allows it to slip rotatably relative to the center wheel pinion 108*b* when handsetting is being performed. Further, the center wheel 108*a* is horizontally overlapped by a portion of the battery 110 and also partially overlaps the stator 107. Interference between the center wheel 108*a* and the battery 110 in a vertical direction is avoided by providing a curved portion 110*a* (FIG. 4) on the housing of the battery 110.

An hour wheel 116 is rotatably positioned against the center wheel pinion 108*b* and its freedom to shake is determined by the hour-wheel bridge 117 and the lower end piece 115 used to support the third wheel and pinion assembly 111. One end of the lower end piece 115 and one end of the hour-wheel bridge 117 are aligned and located by the bridge foot pin 118 and are connected to the plate 101 by means of the screw 122. The outer diameter of the toothed wheel 116*a* of the hour-wheel assembly 116 is larger than that of the center wheel 108*a* and horizontally overlaps the lower tenon of the third wheel and pinion assembly 111.

Table I lists the number of teeth, gear module, outer diameter and the center distance between the rotating axes of engaging members in the gear train according to this invention and for the conventional gear trains shown in FIGS. 1 and 2. In the gear train of this invention (FIG. 4), the reduction ratio between the rotor pinion 106*b* and the fifth wheel 105*b* is 8, and the reduction ratio between the fifth pinion 105*a* and the fourth wheel 104*a* is 3.75. Thus, an angular deceleration of 1/30 is provided. As shown in Table I, the module is 0.05 mm. The center distance between the axis of the rotor 106 and the axis of the fifth wheel and pinion assembly 105 is 1.55 mm. The outer diameter of the fifth wheel 105*b* is 2.84 mm, and the radius of the fifth wheel 105*b* is larger than the center distance between the axis of the fifth wheel and pinion assembly 105 and the fourth wheel and pinion assembly 104, that is, the tenon of the fourth wheel and pinion assembly is overlapped by the wheel 105*b*.

TABLE I

| Gear train in FIG. 1 | number of teeth | module | outer diameter (mm) | center distance in engagement (mm) |
|---|---|---|---|---|
| rotor pinion | 7 | 0.06 | 0.527 | 1.68 |
| fifth wheel | 49 | 0.06 | 3.05 | |
| fifth pinion | 7 | 0.064 | 0.583 | 1.056 |
| intermediate wheel | 26 | 0.064 | 1.769 | |
| fourth wheel | 30 | 0.064 | 2.04 | 1.792 |

| Gear train in FIG. 2 | number of teeth | module | outer diameter (mm) | center distance in engagement (mm) |
|---|---|---|---|---|
| rotor pinion | 10 | 0.066 | 0.75 | 1.65 |
| sixth wheel | 40 | 0.066 | 2.68 | |
| sixth pinion | 7 | 0.065 | 0.543 | 1.593 |
| fifth wheel | 42 | 0.065 | 2.855 | |
| fifth pinion | 48 | 0.032 | 1.633 | 1.728 |
| fourth wheel | 60 | 0.032 | 2.00 | |

| Gear train in FIG. 4 | number of teeth | module | outer diameter (mm) | center distance in engagement (mm) |
|---|---|---|---|---|
| rotor pinion | 6 | 0.0574 | 0.47 | 1.55 |
| fifth wheel | 48 | 0.0574 | 2.841 | |
| fifth pinion | 8 | 0.0553 | 0.54 | 1.05 |
| fourth wheel | 30 | 0.0553 | 1.75 | |

The center distance between the rotor 106 and the fifth wheel and pinion assembly 105 is limited by the inner diameter D (FIG. 4) of the opening in the stator 107 and the remaining thickness t. If a timepiece is to be made smaller, it cannot be accomplished by variations in the inner diameter D because this dimension cannot change substantially due to the required electromagnetic characteristics. Accordingly, the center distance between the rotor 106, 6, 6' and the wheel directly engaging the rotor 106, 6, 6' does not change substantially, as illustrated for each embodiment in Table I.

In the prior art (FIG. 1), in order to avoid an interference between the fourth wheel and pinion assembly 4' and the fifth wheel and pinion assembly 5' in such a combination of gear trains, the center distance between the fifth wheel and pinion assembly 5' and the fourth wheel and pinion assembly 4' is enlarged to avoid interference. Such enlargement is accomplished by utilizing an intermediate wheel 20. In another embodiment of the prior art (FIGS. 2 and 3), four wheels are used and the angular speed reduction between their respective engagements is made small and the diameters of the respective wheels are made small. However, in such a structure, the disadvantages discussed above are produced.

In the gear train according to this invention, the upper tenon of the fifth wheel and pinion assembly 105 is rotatably supported by the fifth wheel bridge 103. The upper tenon of the fourth wheel and pinion assembly 104 is rotatably supported by the third wheel bridge 102. The fifth wheel 105*b* is located between the third wheel bridge 102 and the fifth wheel bridge 103. As a result, the fifth wheel 105*b* and the tenon of the fourth wheel and pinion assembly 104 are overlapping horizontally. Therefore, the diameter of the fifth wheel 105*b* can be selected, and the interference between the fourth wheel and fifth wheel assemblies can be avoided, regardless of the center distance between the fourth wheel and pinion assembly 104 and the fifth wheel and pinion assembly 105.

The outer diameter of the fourth wheel 104*a* in the gear train mechanism of this invention is 1.75 mm, which is substantially the same as the diameter of the prior art fourth wheels. Accordingly, when using the same battery as used in the prior art, the diameter of the battery portion of the casing as seen in the plan view is not much changed. However, the elevational space which can be provided by elimination of one wheel is large, and parts, for example, of the stator 123, can be located on the side closer to the center of the timepiece than in the prior art. So, as shown in FIG. 5, the plate 101 can be made almond-shaped, and the minor axis d (FIG. 5) is made smaller than in the prior art case (FIG. 3).

As indicated above, in the gear train of this invention, the transmitting efficiency of the entire gear train is improved by the reduction in the number of wheels. A lowered-output power requirement for the motor and a low current consumption from the battery are realized and battery life is extended. Furthermore, by combining the gear train of this invention with a battery which has a larger outer diameter and larger electrical capacity, it is possible to provide a timepiece with an outer diameter of 26 mm which has a remarkably long battery life.

In summarizing, the horizontal or plan dimensions of the timepiece are made smaller by decreasing the number of wheels in the gear train, and as a result, additional space, as seen in an elevational view, is obtained. The timepiece is made smaller by optimum utilization of such available additional space. With a gear train designed in accordance with this invention, it becomes possible to provide various casing configurations and designs, and as a result, the esthetic appeal of the timepiece as a commercial product can be enhanced.

In comparison to a method of construction wherein all the wheels are rotatably supported by a single plate, the construction for support of the wheels according to this invention is significantly improved. As stated above, this results from the fact that the rotatably mounted wheels are divided between two supporting plates in a well-balanced manner. This method of support has a great advantage, especially when the timepiece is being mass-produced by automatic techniques. By using two plates, compensation is made for a lack of strength, which occurs when a plate has become very thin because of miniaturization and general thinning of the timepiece. Using two plates raises the strength of the timepiece as a whole. Thus, a timepiece using the gear train according to this invention has high reliability and high durability, and the resultant timepiece is smaller, more reliable, more durable and better suited to mass-production techniques than the prior art timepieces.

Herein, the gear train mechanism of this invention has been described using a battery-operated timepiece as an example. However, in the gear train of an entirely mechanical timepiece, the same advantages in relation to size and strength can be obtained by using the gear train design according to this invention, so that the complete barrel with arbor of the mechanism is arranged to be near the center of the timepiece.

What is claimed is:

1. A gear train mechanism for a timepiece including means for timekeeping and a rotating second hand for display, comprising:

a fourth wheel and pinion assembly having a tenon for support of said fourth wheel and pinion assembly in said timepiece, said second hand being attached to said fourth wheel and pinion assembly for rotation therewith;

an intermediate wheel and pinion assembly for transmitting motion to said fourth wheel and pinion assembly, the outer radius of said intermediate wheel overlapping said tenon of said fourth wheel and pinion assembly.

2. A gear train mechanism for a timepiece as claimed in claim 1, and further comprising:

a rotor assembly, said rotor assembly being driven in rotation by said means for timekeeping, said rotor assembly including a pinion, the wheel of said intermediate wheel and pinion assembly rotatably engaging said pinion of said rotor assembly, the pinion of said intermediate wheel and pinion assembly rotatably engaging the wheel of said fourth wheel and pinion assembly, the tooth ratios of said engaged wheels and pinions producing a deceleration in angular velocity, whereby said rotation of said rotor assembly produces an angular rotation of said second hand, said angular rotation of said second hand being accurately indicative of the passage of time.

3. A gear train mechanism for a timepiece as claimed in claim 2, wherein said rotor assembly rotates 180 degrees and said second hand rotates 6 degrees each time said rotor assembly is driven.

4. A gear train mechanism as claimed in claim 2, and further comprising a fifth wheel bridge, said intermediate wheel and pinion assembly being rotatably mounted at its top end to said fifth wheel bridge, and a third wheel bridge below said fifth wheel bridge, the top end of said fourth wheel and pinion assembly being rotatably mounted on said third wheel bridge, said intermediate wheel being positioned between said third and fifth wheel bridges, whereby said intermediate wheel, regardless of diameter, does not interfere with said fourth wheel and pinion assembly.

5. A gear train mechanism as claimed in claim 3, wherein said rotor assembly pinion has six teeth, said intermediate wheel has 48 teeth, said intermediate pinion has eight teeth, and said fourth wheel has 30 teeth.

6. A gear train mechanism as claimed in claim 5, wherein the center distance between said rotor assembly pinion and said intermediate wheel is 1.55 mm, and the center distance between said intermediate pinion and said fourth wheel is 1.05 mm.

7. A gear train mechanism as claimed in claim 2 or 6, and further comprising:

a plate rotatably supporting the lower ends of said rotor assembly and intermediate wheel and pinion assembly;

a center wheel and pinion assembly for driving a minute hand, said center wheel and pinion assembly being concentric with said fourth wheel and pinion assembly, the wheel of said center wheel and pinion assembly being on the opposite side of said plate from said intermediate wheel and pinion assembly, whereby said center wheel and said intermediate wheel and pinion assembly do not interfere with each other.

8. A gear train mechanism as claimed in claim 7, and further comprising a third wheel and pinion assembly, said center wheel engaging the pinion of said third wheel and pinion assembly, and the pinion of said fourth wheel and pinion assembly engaging the wheel of said third wheel and pinion assembly.

9. A gear train mechanism as claimed in claim 8, wherein said rotor assembly is rotatably mounted at its top end to said fifth wheel bridge, and further comprising a lower end piece, said lower end piece supporting the lower end of said third wheel and pinion assembly, the upper end of said third wheel and pinion assembly being supported in said third wheel bridge, whereby said third and fifth wheel bridges each support the upper ends of two assemblies for rotation.

* * * * *